US006595725B1

(12) United States Patent
Shotbolt

(10) Patent No.: US 6,595,725 B1
(45) Date of Patent: Jul. 22, 2003

(54) TETHERED BUOYANT SUPPORT FOR RISERS TO A FLOATING PRODUCTION VESSEL

(75) Inventor: Keith Shotbolt, Reading (GB)

(73) Assignee: Foster Wheeler Energy Limited, Reading (GB)

( * ) Notice: Subject to any disclaimer, the term of this patent is extended or adjusted under 35 U.S.C. 154(b) by 0 days.

(21) Appl. No.: 09/856,551

(22) PCT Filed: Nov. 23, 1999

(86) PCT No.: PCT/GB99/03900

§ 371 (c)(1),
(2), (4) Date: Aug. 28, 2001

(87) PCT Pub. No.: WO00/31372

PCT Pub. Date: Jun. 2, 2000

(30) Foreign Application Priority Data

| | | |
|---|---|---|
| Nov. 23, 1998 | (GB) | 9825627 |
| Dec. 21, 1998 | (GB) | 9828213 |
| Jan. 14, 1999 | (GB) | 9900802 |
| Jan. 20, 1999 | (GB) | 9901260 |
| Feb. 9, 1999 | (GB) | 9902897 |
| Mar. 11, 1999 | (GB) | 9905613 |
| Sep. 15, 1999 | (GB) | 9921844 |

(51) Int. Cl.[7] ..... E21B 43/013; E21B 17/01

(52) U.S. Cl. ..... 405/224.2; 166/348; 166/345; 166/352

(58) Field of Search ..... 405/169, 170, 405/171, 172, 158; 166/367, 359, 351, 350, 345

(56) References Cited

U.S. PATENT DOCUMENTS

| | | | | |
|---|---|---|---|---|
| 4,400,110 A | * | 8/1983 | Beynet et al. | 405/169 |
| 4,423,984 A | * | 1/1984 | Panicker et al. | 405/195.1 |
| 5,505,560 A | * | 4/1996 | Brown et al. | 405/169 |
| 5,639,187 A | | 6/1997 | Mungall et al. | 405/195.1 |
| 5,957,074 A | * | 9/1999 | de Baan et al. | 114/230.12 |
| 6,109,833 A | * | 8/2000 | Savy | 405/169 |

FOREIGN PATENT DOCUMENTS

| | | |
|---|---|---|
| EP | 0 251 488 | 1/1988 |
| GB | 2 295 408 | 5/1996 |
| WO | 95/18907 | 7/1995 |

OTHER PUBLICATIONS

Barltrop, N.D. P, Ed. *Floating Structures: a guide for design and analysis*. Oilfield Publications Limited, 1998: Herefordshire, England. pp. 3, 13–8, 13–9, 13–25 and 13–26.

Alexander, Charles H. et al., "*A Hybrid Riser for Deep Water*, " Offshore South East Asia 10$^{th}$ Conference & Exhibition, Dec. 6–9, 1994, pp. 107–114.

(List continued on next page.)

*Primary Examiner*—Heather Shackelford
*Assistant Examiner*—Frederick Lagman
(74) *Attorney, Agent, or Firm*—Fitzpatrick, Cella, Harper & Scinto

(57) ABSTRACT

A mid-water tethered buoyant support assembly for a riser system for use in water is described to bring fluids from seabed equipment to a production vessel at the surface. The tethered buoyant support assembly comprises at least two tethers (6) from seabed anchors, at least one beam assembly (2) extending between and connected to the tops of the tethers, buoyancy means (7) to maintain tension in the tethers, and hangers (10) for lower riser portions mounted at spaced positions along the beam assembly, each hanger (10) being positioned so that the line of action of the tension due to the weight of the suspended lower riser portion is close to or on a line extending between the connections of the beam to the tethers (6) to minimize or eliminate turning moment to the beam assembly (2) tending to cause rotation of the beam around its major axis as a result of the weight of the suspended lower riser portion. The assembly is particularly designed for use in deep water.

27 Claims, 3 Drawing Sheets

OTHER PUBLICATIONS

Loughridge, John. "*Installation of The Griffin FPSO and Associated Subsea Construction*, " Stena Offshore Limited, Dec. 1994, 14 pages total.

Phifer, E.H., et al., "*Design and Installation of Auger Steel Catenary Risers*, "Offshore Technology Corporation, May, 1994, pp. 399–408.

Uittenbogaard, R., et al. "*Integrated Asymmetric Mooring and Hybrid Riser System for Turret Moored Vessels in Deep Water*, " Offshore Technology Corporation, May 1997, pp. 1–12.

International Search Report; completion date Feb. 4, 2000; mailing date Nov. 20, 2000; M. Garrido Garcia, Authorized Officer.

* cited by examiner

TETHERED BUOYANT SUPPORT FOR RISERS TO A FLOATING PRODUCTION VESSEL

This invention relates, to a tethered buoyant support for risers to a floating production vessel, the tethered buoyant support being at a mid-water location for supporting the riser pipe catenaries.

A lower J-shaped catenary extends from the seabed to the support, and an upper U-shaped catenary extends from the support to the vessel floating at the surface. The riser system with a single buoyant support can comprise multiple riser pipes, all of them with lower and upper catenaries. Previous similar catenary riser systems have been described in EP 251488 and UK 2295408.

In all water depths, the upper catenary is usually fabricated from flexible pipe or 'flexpipe'. Flexpipe is able to absorb vessel motion in waves without being vulnerable to fatigue failure, and has been used for most risers to floating production vessels in service in 1998. Flexpipe is here defined as high pressure flexible pipe, which usually includes helical high-strength windings (such as steel or possibly carbon fibre) to re-inforce polymer tubes or an elastomer matrix.

In deep water (greater than 500 m) it is desirable to fabricate the lower catenary from steel pipe rather than flexpipe, due to the steel pipe having long length relative to its diameter (the length being around 1000 times greater than the diameter, or more). Steel catenary riser (SCR) technology to a tension leg platform (TLP) is described in a technical paper entitled 'Design and Installation of Auger Steel Catenary Risers' presented at the Offshore Technology Conference in Houston, May 1994, paper number OTC 7620. UK 2295408 describes the application of SCRs with a tethered buoyant mid-water support, rather than to a TLP.

Installation of tethered buoyant supports in 130 m water depth offshore North West Australia is described in 'Installation of the Griffin FPSO and Associated Subsea Construction', paper presented at the Floating Production Systems Conference, in London, Dec. 8–9, 1994. Each cylindrical buoy was 3.7 m diameter and up to 14 m long with chain tethers from each end down to a seabed base. The buoy was positioned approximately 45 m below the sea surface. The buoys carried arches for supporting flexpipe risers and umbilicals, and the arch radius was approximately 3 m, with the buoy cylinder positioned centrally under the arches (at least before installing flexpipe risers).

In deep water, the tension at the top of the lower J-shaped catenary extending from the mid-water support to the seabed can be very large due to the submerged weight of the long length of the lower catenary pipe. The paper OSEA-94113, 'A Hybrid Riser for Deep Water' presented at the Offshore South East Asia Conference, Singapore, Dec. 6–9, 1994, suggests that multiple SCRs from a mid-water support located 100 to 150 m below surface in 1200 m depth, will have a combined submerged weight of 1200 tonnes. The paper OTC 8441—'Integrated Asymmetric Mooring and Hybrid Riser System for Turret Moored Vessels in Deep Water', presented at the Offshore Technology Conference, Houston, May 5–8, 1997—describes a tethered riser buoy in 1000 m water depth for supporting up to approximately 800 tonnes of load from 15 risers and umbilicals. Paper OTC 8441 suggests that a concrete buoy for this application should be 8 m diameter and 80 m long, and should generate 1200 tonnes of tether tension to provide adequate lateral stability.

The problem with hanging a load of 800 to 1200 tonnes from a circular section buoy with a centrally-positioned support arch of 3 to 4 m radius is that the moment of up to 4800 tonne-meters will tend to rotate the buoy. Also, the rotation could bend the upper ends of the risers unless they are hanging from a 'hinged' (i.e. free) support.

Even if the lower riser portion submerged weight can be reduced by adding a low density coating, or by using pipe-in-pipe construction with a gas-filled annulus, the hanging weight is still likely to be hundreds of tonnes.

The invention has therefore been made with these points in mind.

According to the invention there is provided a mid-water tethered buoyant support assembly for a riser system for use in water to bring fluids from seabed equipment to a production vessel at the surface, the tethered buoyant support assembly comprising at least two tethers from seabed anchors, at least one beam assembly extending between and connected to the tops of the tethers, buoyancy means to maintain tension in the tethers, and hangers for lower riser portions mounted at spaced positions along the beam assembly, each hanger being positioned so that the line of action of the tension due to the weight of the suspended lower riser portion is close to or on a line extending between the connections of the beam to the tethers, to minimise or eliminate turning moment to the beam assembly tending to cause rotation of the beam around its major axis as a result of the weight of the suspended lower riser portion.

Such an assembly supports the lower riser weight with minimum tendency to cause rotation of the tethered buoyant support. In addition it is possible to provide a large amount of adjustable buoyancy at the support form which is readily fabricated. Further, there is resistance to rotation of the support when flexpipe upper catenaries are added.

Advantageously, the distance between the line of action of the tension of a lower riser portion and the line extending between the tops of the tethers is at most one quarter of the distance from the centre of buoyancy of the buoyancy means to the tops of the tethers. More advantageously, the distance between the line of action of the tension of any lower riser portion and the line extending between the tops of the tethers is at most one twentieth of the distance from the centre of buoyancy of the buoyancy means to the tops of the tethers.

The tethered buoyant support may include joining and/or guiding and/or aligning means for upper riser portions mounted on the beam structure at spaced positions corresponding to the hangers.

The vertical tethers can be similar to the tubular tethers used for TLPs, which are generally steel tubes and have elastomeric bearings at the connection to the seabed anchors. Similarly, the connections of the tethers to the beam can be elastomeric bearings.

The horizontal beam structure can be two tubes around 2 m diameter and spaced around 4 m apart by minor tubular members in the manner of a braced truss around 50 m in length, and the hangers can be similar to those described in European patent EP 0,251,488 or UK patent application 2,323,876. The means for joining or guiding or aligning the upper riser portions to their corresponding lower riser portions can comprise arches for supporting flexible pipe, or inverted U-shaped piping spools, or funnels or guide posts for aligning connectors.

The main buoyancy tanks can be circular cylinder-shaped with the major axis vertical or rectangular block-shaped, and with the attachment to the beam at the centre of the lower face. The tanks may have dimensions around 20 m high×10 m diameter (1570 cu.m. displacement) if this large amount of buoyancy is needed, depending on the total riser weight to be supported. The inside of the tanks can be partitioned to allow progressive increase of the buoyancy by de-ballasting pairs of partitions to maintain the buoy and beam close to vertical. Each de-ballastable compartment has suitable valves to allow injection of air or nitrogen to the top, and ejection of contained water at the bottom, with minimum overpressure of the gas above external water pressure.

Specific embodiments of the invention will now be described by way of example with reference to the accompanying drawings in which.

Figure 1:
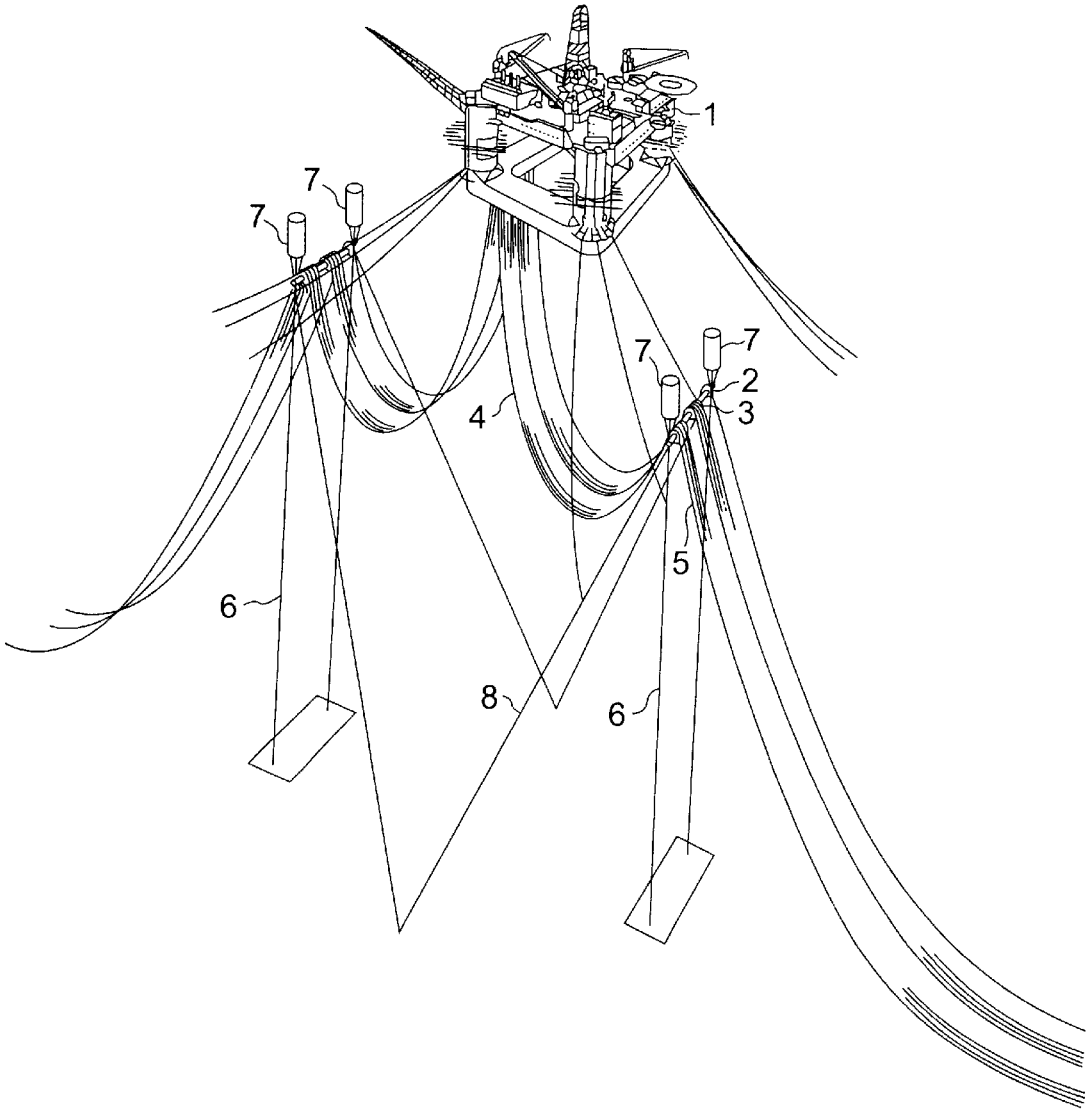
FIG. 1 is an isometric view of an entire floating production system showing multiple riser pipes to/from the seabed.

Referring to FIG. 1, the production vessel 1 is floating on the sea surface. A mid-water support in the form of a beam structure 2 has support arches 3 for flexpipe upper riser portions 4. Lower riser portions 5 extend down to the seabed. Tethers 6 maintain the beam structure at the desired depth and buoyancy tanks 7 support the weight of the entire assembly including the riser tensions and keep the tethers taut. Guy lines 8 help to balance the lateral component of lower riser tension and prevent lateral movement due to water current.

Figure 2:
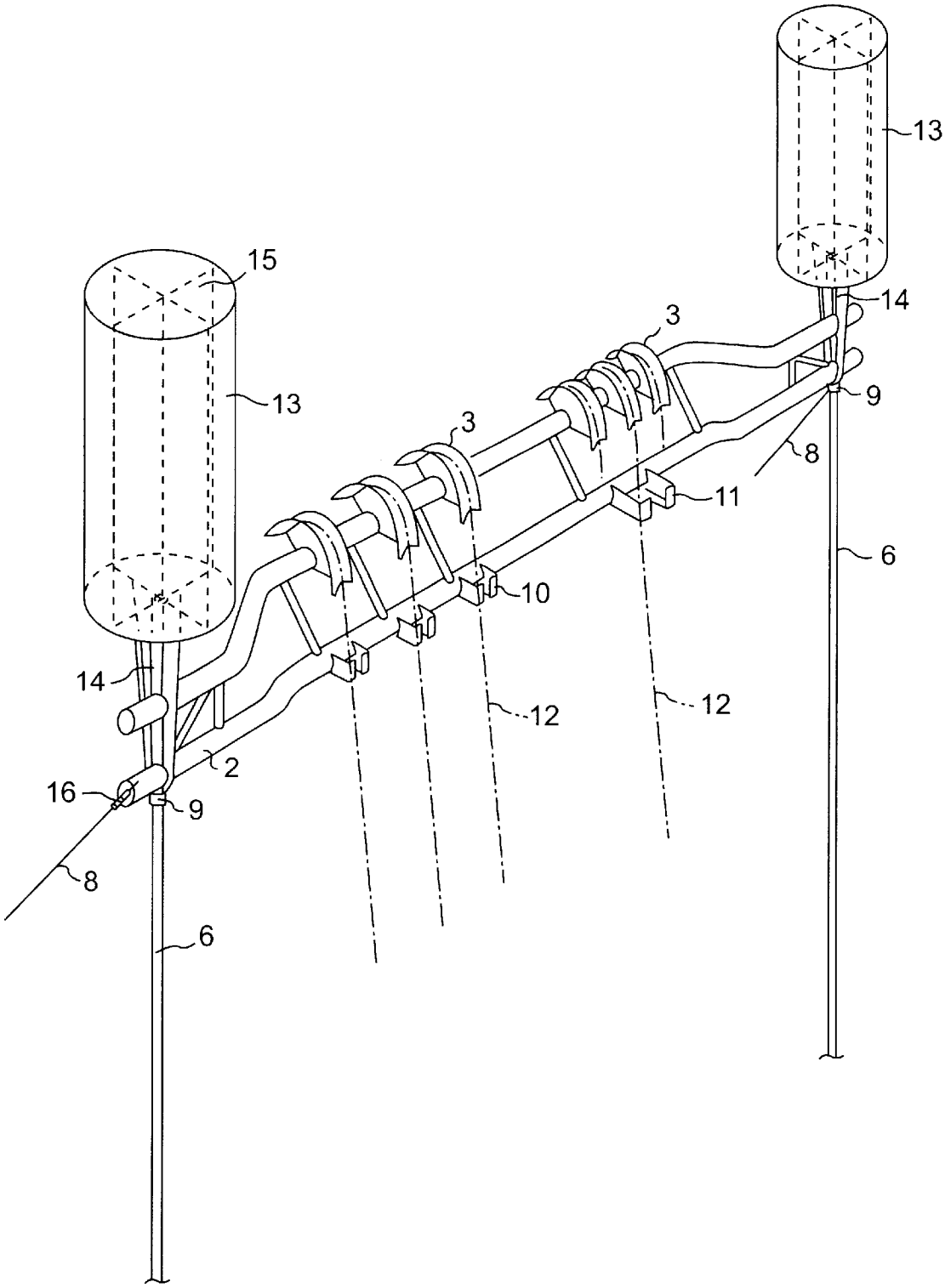
FIG. 2 is an isometric view of the beam structure with tethers and buoyancy tanks at each end.

FIG. 2 is an isometric view of a beam structure 2 attached to tethers 6 by elastomeric bearings 9. The beam 2 supports arches 3 and hangers 10 for single line risers, and three arches 3 associated with hanger 11 for a riser bundle containing three lines. Another possible reason for a single lower riser portion having multiple associated arches is that the lower riser portion is large, say 24", and the upper flexpipe riser portions having limited diameter, say 16" maximum. Hangers 10 and 11 may have hinged or elastomeric bearing attachment to the beam structure to permit hanger alignment with the lower riser portions (only centre-line positions 12 of the lower risers are shown). The centre-line positions 12 are equivalent to the lines of action of lower riser tensions at the hangers 10 and 11. Buoyancy tanks 13 are mounted on arms 14 integral with the beam 2, and are positioned above the tethers 6. Partitions 15 in the buoyancy tanks 13 provide some stiffening, some redundancy if one buoy compartment fails and floods, and may allow finer adjustment of buoyancy by de-ballasting segments only. Guy lines 8 have means 16 for adjustment of their tension where they attach to the beam 2.

Figure 3:
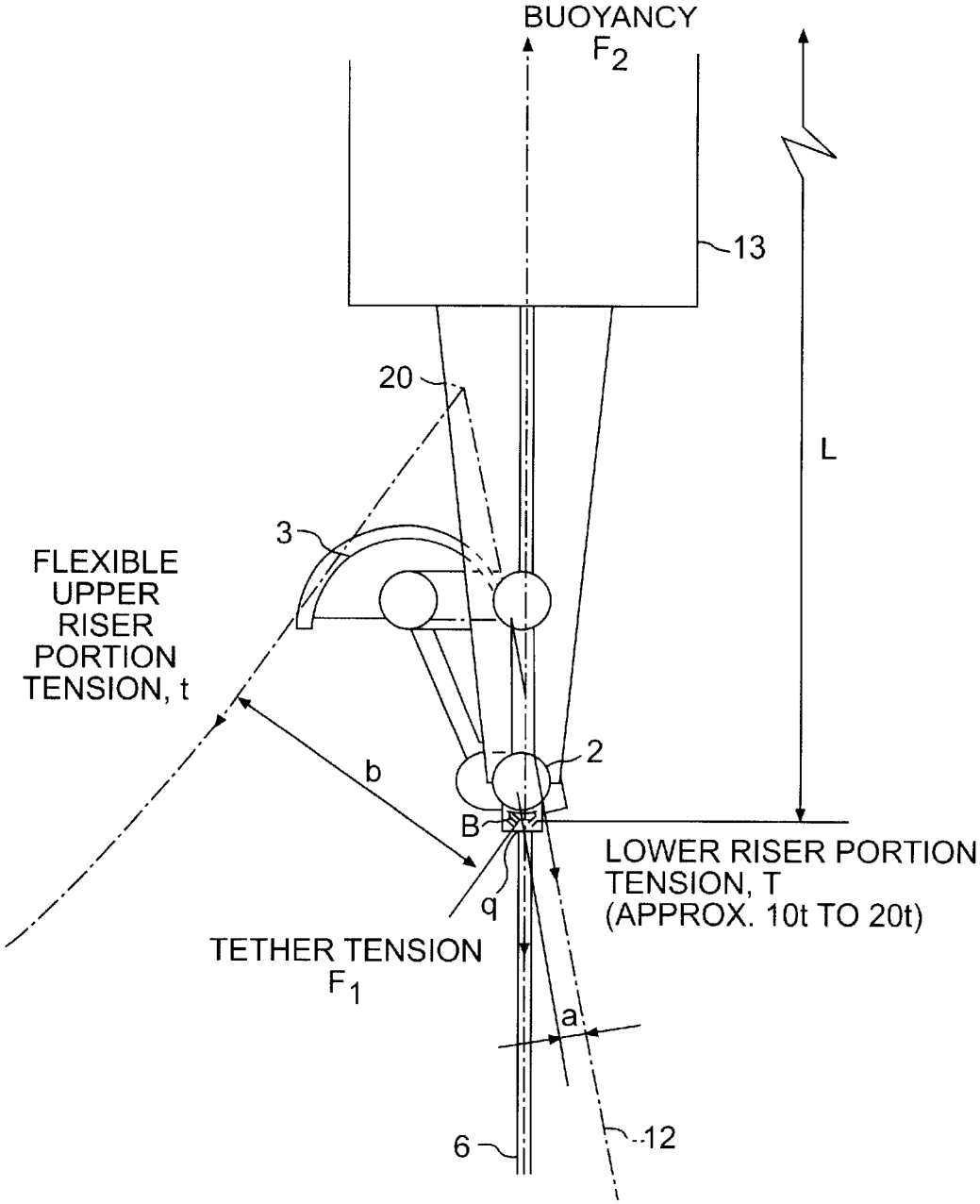
FIG. 3 is an end view of the beam showing the relative position of the tether bearings, buoyancy, and the applied riser loads.

FIG. 3 shows the beam 2 connected to tethers 6 by bearings 9. Label 'B' represents the top of the tether, and the second tether will have a corresponding point 'B'. When a lower riser is installed, the line of action of its tension 'T' (centre-line 12) exerts a moment of 'T times a' trying to rotate the beam. Distance 'a' is between the line of action of the tension, and the line extending between the tops of the tethers (of which point 'B' is an end view) and is preferably less than 1.5 m, and more preferably less than 0.8 m. This tendency for the beam 2 to rotate will try to move the centre of buoyancy (located at distance 'L' above point 'B') of the buoyancy tanks 13 away from their normal position vertically above point 'B'. The buoyancy force will then start to generate an opposing moment, and will reach a stable position where the returning moment due to the displaced centre of buoyancy balances the moment arising from the lower riser tension 'T times a'. If 'a' is small and 'L' is large, then there will be very little rotational movement of the beam 2. Preferably, L is at least 3 m, and more preferably at least 5 m. For example, L could exceed 10 m if the tanks 13 are 20 m high as described above.

When a flexpipe upper section 4 is added over arch 3 to connect the lower riser portion to the surface vessel, its catenary will exert a tension 't' which is less than lower portion tension 'T'. It will act at moment arm 'b' from point 'B', and will act to counter some of the moment 'T times a', thus bringing the centers of buoyancy of the buoyancy tanks 13 back closer to their starting position, vertically above points 'B'. Thus, as seen in FIG. 3, the sum of the moments caused by the tensions of the upper and lower riser portions about the line extending between the points 'B' is minimized or eliminated. That is:

$$T \cdot a - t \cdot b \approx 0.$$

The lower risers portions 5 can be from flexpipe or steel, and the angle between a lower riser portion centre-line 12 (representing the line of action of its tension at its approach to its support 11) and vertical is likely to vary as listed below:

| Type of lower riser portion | Angle of centre-line 12 to vertical |
|---|---|
| Flexpipe/umbilical | <5 degrees |
| Steel pipe (4" to 8" NB) | around 10 degrees |
| Steel pipe (>10" NB) | >15 degrees |

If the lower riser portions 5 for a particular project have similar angles of centre-line 12 to vertical at the approach to their hangers 11, may be possible to reduce the turning moments 'T times a' and 't times b' to lower values, as described below.

FIG. 2 shows the beam 2 offset, or 'cranked', in the horizontal plane, so that the hangers can be closer to the line extending between the tops of the tethers 'B'. It may be advantageous to also offset the beam 2 in the vertical plane. The lines of action of the tensions 't' and 'T' in the upper and lower riser portions are shown in FIG. 3. If these centre-lines are extended backwards, they intersect at a point 20 above the beam 2 and support arch 3. The turning moments 'T times a' and 't times b' will be reduced to lower values if the beam 2 is offset downwards by around 5 meters. This will bring the intersection point between the lines of action of the tensions 't' and 'T' closer to the line extending between the tops of the tethers 'B', thus reducing any tendency to rotate the beam 2.

The amount of horizontal and vertical plane offset, or 'crank', in the beam 2 for a particular water depth/riser size/etc. must be determined during detail design following evaluation of:

a) the forces acting at the mid-water tethered buoyant support, b) the stresses developed in the beam, and c) the cost-effectiveness of introducing greater complexity to beam fabrication.

FIG. 4 of European patent no. EP 251488 shows some risers passing back under the beam structure rather than laying away from it, as shown in the present FIG. 1. Beam structure 2 can support a riser which passes under it (not shown here), and which has a short length of flowline lying on the seabed to equipment under the floating vessel 1. In that case the centre-line 12 in FIG. 3 would still be spaced at small distance 'a' on the right-hand side of point 'B', but would cross the centre-line of tether 6 at a relatively short distance below point 'B'. Beam structure 2 would still be cranked in the direction shown in FIG. 2, as the riser hang-off operation would approach the hanger 10 from the same side. A detailed description of this operation where the riser passes under the beam 2 was given in Offshore Engineer magazine, July 1987, page 41.

Another variation for riser hang-off would be where long flowlines and/or long export lines approach the beam structure from opposite sides. In this case, where the hang-off operations are on opposite sides of the beam, the corresponding hangers 10 should also be on opposite sides of the beam 2. In this case, a single riser support system would support lines approaching from both sides rather than having two riser support systems as shown in FIG. 1. The beam 2 would also need to be cranked in both directions; preferably symmetrically with, say, an export line at each end (from one direction) and all the flowlines in the centre section (from the opposite direction). However, all the flexpipe links 4 would still leave the beam in the same direction. For those positions where the flexpipe link and the hanger for lower J-catenary are on the same side of the beam, the arch 3 and its support will need to be added after the lower J-catenary has been hung off.

In another embodiment of the invention, the main part of the buoyancy which maintains tension in the tethers can be located at, near or around the top ends of the tethers themselves, rather than above the tethers. This has the advantage of increasing the clearance between the production vessel mooring lines and the tethered buoyant riser support assembly but has the disadvantage that the buoyancy will not oppose any turning moment. In this case the beam has fixed connections at or near the tops of the tethers plus buoyancy means. It may be possible to make the tethers and any guy lines from relatively low cost, synthetic fibre ropes. It remains necessary to prevent application of a large turning moment to the beam (tending to cause rotation of the beam around its major axis) when the high load of the lower riser portions is applied to the hangers.

When laying an offshore pipeline towards a seabed target area which may be only 3 meters long by 3 meters wide, the lay-vessel must know its position with respect to where to cut the pipeline (which is fabricated from 12 meter or 24 meter lengths). The cut must be made, and the 'lay-down head' welded to the end, so that when the end of the pipeline has travelled over the curved ramp or 'stinger', the end of the line is laid down in the target area. Gauging of the 'distance-to-target' can be done using sonar methods, but there is a working tolerance of approximately+/−1 meter.

When laying towards a submerged tethered riser support into hangers 10, the effective width of the hanger target can be increased by adding angled guide arms which act to 'funnel' the riser into the required position. These guide arms can be detachable, and can be installed at a selected hanger position by a diver or an ROV.

The 'distance-to-target' can only be gauged within a tolerance of approximately +/−1 meter, and the J-catenary geometry of the lower riser portion 5 will in some cases be able to accept this variation in length without causing excessive bending stress in the 'sag-bend'. If the lower riser portion length must be precisely controlled to keep bending stress within a certain limit (i.e. the catenary geometry can not absorb the potential length variation), then it may be necessary to provide hangers 10 and 11 with adjustment means to accommodate the variation of J-catenary effective length.

Hangers 10 and 11 can be attached to beam structure 2 by linear adjustment means (not shown) which can vary the position of the hanger along the line of action 12 by approximately plus/minus 2 meters after lower riser portion 5 hang-off. The linear adjustment means can be supported temporarily by a hydraulic actuator, which can change the elevation of the hanger 10 and 11 with respect to the beam 2. After adjusting the height of the hanger, the adjustment means can be locked in position by adding pins in the nearest 'match' of a series of holes. Alternatively, the adjustment means can follow the principle of a typical 'screw jack', rather than a 'pin-lockable-slide' in conjunction with a temporary hydraulic jacking actuator.

Another method of providing adjustment would be to set the hanger 10 at a relatively low position, install the lower riser portion 5 and lift its upper end using the lay vessel winch until the weight-support-flange at the end of the line is at the correct position. A support collar of half-shells, made up to the required length, could then be added to take up the distance between the weight-support-flange and the hanger.

A further alternative, to ensure that the riser portion 5 of a particular flowline or pipeline is cut to the correct length, is to lower the top end of the riser pipe catenary with at least 3 m of extra length attached, down to the hanger position. This lowering activity would be done, for either a seabed lay-down or a mid-water hang-off, by using a winch line from the pipelay vessel. Previous analysis will have predicted a desired top tension, top angle to vertical, and touch-down point at the seabed for this particular steel catenary riser. The winch line holding the riser weight can be adjusted to give the required tension, or angle, or touch-down point, and an ROV or diver can mark the necessary cut position relative to the hanger 10,11. After retrieving the riser top back to surface, the catenary portion 5 should be cut to the required length for attachment of the hanger flange and lower part of a connector to ease future connection to the corresponding flexpipe upper portion 4 of the riser. Before lowering the top end of the riser portion 5 back down to its hanger 10 or 11, consideration must be made of any hydrotesting that may be required for a complete flowline and riser. This testing may need a pig trap to be installed at the top of the catenary portion 5 to allow controlled flooding, prior to testing or attaching the flexpipe portion 4.

There have been two types of buoyant mid-water supports for flexpipe catenary risers to date. The first type is used for 'steep' riser configurations where the lower riser portion is attached at its lower end to a fixed riser base on the seabed, and the mid-water support with riser arch is 'tethered' in position by the flexpipe itself. This type of riser is usually installed in one piece with the mid-water support attached, and lowered simultaneously with the riser. The second type is used for supporting 'lazy' riser configurations where the lower catenary touches down tangentially at the seabed. This type can also be installed simultaneously with the riser pipe, but when used to support a large number of risers, it is more usual to pre-install the mid-water support with arches. The pre-installation activity for six mid-water supports is described in the previously noted reference at the top of page 2, related to the Griffin field facilities off Australia. The improvements described in this application relate only to pre-installed tethered buoyant riser supports which have a tether system attached to seabed points of fixity, and to which the risers are installed in close-to-catenary configuration with tangential touch-down at seabed after mid-water buoy installation is complete.

At some time after the tethered buoyant support has been installed, a tether may be damaged and may need to be replaced. This replacement operation can be made easier if additional fixing points for the ends of a replacement tether are already provided at both the seabed anchors and at the ends of beam 2. After installing a new tether, the old damaged one can be safely removed. There is a philosophy for tethered (usually manned) platforms to be installed with at least two tethers per necessary anchor point, so that if one tether fails, the other prevents catastrophic instability and failure of the platform. In the case of a tethered buoyant riser support, each tether is likely to be very strong and damage is likely to cause only partial loss of strength. This damage would probably be detected during periodic ROV inspection, and an assessment can be made of the urgency for its replacement. The very unlikely failure of a riser support system may lead to failure of a lower catenary riser pipe 5, but major release of hydrocarbons to the sea would be prevented by numerous near-wellhead valves located both above and below the seabed.

In FIG. 3, the arch 3 has one end close to tangential with the centre-line 12 to allow alignment for near-vertical connection of an upper flexpipe portion 4 to its corresponding lower catenary portion 5. It should be noted that previous arches over tethered buoyant riser supports (such as those described for the Griffin field facilities in the reference at the top of page 2) were located close-to-centrally with respect to the near-vertical line of the tethers. That is, the centre of the radius of each arch is close to the plane of the two tethers. In the end view of the beam shown in FIG. 3, the arch 3 is significantly offset with respect to the centreline of the tether 6. This allows the centre-line 12 to be close to (or on) a line extending between the connections 9 of the beam to the tethers, thus greatly reducing the tendency for the beam to rotate when a lower catenary portion 5 is hung off at its corresponding hanger 10,11.

In the book 'Floating Structures: a guide for design and analysis' prepared by the (UK) Centre for Marine and Petroleum Technology in 1998 and published by Oilfield Publications Limited, Chapter 13 is entitled 'Flexible Risers and Umbilicals'. This chapter includes a description and drawing (FIG. 13.11) of a typical mid-water support. The drawing shows the attachment point of the tether at the far side of the arch centreline from the riser leg that descends to the RBM (Riser Base Manifold) on the seabed. In this position, any high load developed by the hanging weight of the lower riser catenaries down to the seabed will generate a greater turning moment than if the tether had been located at a central position. The present invention recommends positioning the line of action of the hanging weight of the lower catenaries close to the plane containing the (extended) centrelines of the main tethers in order to minimise the associated turning moment.

FIGS. 2 and 3 herein show the main buoyancy tanks 13 positioned above the tethers 6. It may be advantageous to locate trim buoyancy tanks (not shown) along the upper tubular member of beam 2 and under the arches 3. These trim tanks could be used for fine adjustment during or after installing upper riser portions 4. In FIG. 3, the tension 't' from upper riser portion 4 is tending to rotate the beam 2 in an anti-clockwise direction relative to the tether attachment point 'B', and this tendency can be counteracted by adjustment of trim tank buoyancy positioned under the arch 3. The effectiveness of any trim tank buoyancy is obviously greater if the centre of buoyancy is located further to the left of tether attachment point 'B'.

What is claimed is:

1. A mid-water tethered buoyant support assembly for a riser system for use in water to bring fluids from seabed equipment to a production vessel at the surface, the tethered buoyant support assembly comprising:

at least two tethers extending from seabed anchors, wherein said tethers are located in a single plane;

a beam assembly extending between and connected to the tops of said tethers at connections, such that the connections of said tethers to said beam assembly are disposed along said beam assembly to define a line extending between the connections;

buoyancy means attached to said beam assembly for buoyantly supporting said beam assembly, so as to maintain tension in said tethers; and hangers for suspending lower riser portions, said hangers being mounted at spaced positions along said beam assembly and positioned so that lines of action of tension due to the weight of the suspended lower riser portions are closely adjacent to, or on, the line extending between the connections of said tethers to said beam assembly, to minimize or eliminate a turning moment imparted to the beam assembly, which tends to cause rotation of the beam assembly around its major axis, as a result of the weight of the suspended lower riser portions.

2. An assembly as recited in claim 1, wherein the line of action of the tension due to the weight of the suspended lower riser portions is no more than 1.5 m from the line extending between the connections of said tethers to said beam assembly.

3. An assembly as recited in claim 1, further comprising arches, over which upper flexible portions of the riser system are laid, and the upper flexible portions are joined to the lower riser portions at one end of said arches, the major axes of the center of radius of said arches being parallel to, but offset from, the line extending between the connections of said tethers to said beam assembly.

4. An assembly as recited in claim 3, wherein said beam assembly comprises a pair of tubular members, one of which supports said hangers, and the other of which is displaced therefrom and supports said arches, so as to minimize or eliminate a turning moment on said beam assembly as a result of the weight of the suspended lower riser portions.

5. An assembly as recited in claim 1, wherein a center of buoyancy of said buoyancy means is above the line extending between the connections of said tethers to said beam assembly.

6. An assembly as recited in claim 5, wherein a distance of the center of buoyancy of said buoyancy means is at least three meters above the line extending between the connections of said tethers to said beam assembly.

7. An assembly as recited in claim 6, wherein the distance between the lines of action of the tension of the lower riser portions and the line extending between the connections of said tethers to said beam assembly, is at most one quarter of the distance from the center of buoyancy of said buoyancy means to the line extending between the connections of said tethers to said beam assembly.

8. An assembly as recited in claim 6, wherein the distance between the lines of action of the tension of the lower riser portions and the line extending between the connections of said tethers to said beam assembly, is at most one twentieth of the distance from the center of buoyancy of said buoyancy means to the line extending between the connections of said tethers to said beam assembly.

9. An assembly as recited in claim 5, wherein said at least two tethers comprise a pair of tethers, one at each end of said beam assembly, and said buoyancy means comprises a pair of buoyancy tanks, each positioned above a respective one of said pair of tethers.

10. An assembly as recited in claim 5, wherein the center of buoyancy of said buoyancy means is at least five meters above the line extending between the connections of said tethers to said beam assembly.

11. An assembly as recited in claim 1, wherein the assembly is capable of being used in water having a depth greater than five hundred meters.

12. An assembly as recited in claim 1, wherein the line of action of the tension due to the weight of the suspended lower riser portions is no more than 0.8 meters from the line extending between the connections of said tethers to said beam assembly.

13. A mid-water tethered buoyant support assembly for a riser system for use in water to bring fluids from seabed equipment to a production vessel at the surface, the tethered buoyant support assembly comprising:

at least two tethers extending from seabed anchors, said tethers being located in and defining a single plane over at least a portion of their length;

a beam assembly extending between and connected to the tops of said tethers;

buoyancy means attached to said beam assembly for buoyantly supporting said beam assembly, so as to maintain tension in said tethers; and hangers for suspending lower riser portions, said hangers being mounted at spaced positions along said beam assembly, said hangers being positioned closely adjacent to, or on, the plane defined by said tethers in order to minimize or eliminate a turning moment applied to said beam assembly, which tends to cause rotation of said beam assembly around its major axis, as a result of the weight of the suspended lower riser portions.

14. An assembly as recited in claim 13, wherein a distance between each of the hangers and the plane defined by said tethers is at most one meter.

15. A mid-water tethered buoyant support assembly for a riser system for use in water to bring fluids from seabed equipment to a production vessel at the surface, the tethered buoyant support assembly comprising:

at least two tethers extending from seabed anchors;

a beam assembly extending between and connected to the tops of said tethers;

buoyant supports attached to said beam assembly for buoyantly supporting said beam assembly, so as to maintain tension in said tethers;

hangers for suspending lower riser portions, said hangers being mounted at spaced positions along said beam assembly; and upper riser supports for suspending upper portions of the riser system, wherein said beam assembly comprises a pair of elongate members, one of which supports said hangers, and the other of which is displaced therefrom and supports said upper riser supports, so as to minimize or eliminate a turning moment on said beam assembly as a result of the weight of the suspended lower riser portions.

16. An assembly as recited in claim 15, wherein the upper riser portions of the riser system are flexible.

17. An assembly as recited in claim 15, wherein the upper riser supports comprise at least one of arches, inverted U-shaped piping spools, funnels, and guide posts.

18. An assembly as recited in claim 15, wherein said tethers are located in a single plane.

19. A mid-water tethered buoyant support assembly for a riser system for use in water to bring fluids from seabed equipment to a production vessel at the surface, the tethered buoyant support assembly comprising:

at least two tethers extending from seabed anchors;

a beam assembly extending between and connected to the tops of said tethers;

hangers attached to said beam assembly for suspending lower riser portions; and upper riser supports attached to said beam assembly for suspending upper portions of the riser system, wherein said hangers and said upper riser supports are positioned in a radial direction relative to said beam assembly such that the following condition is met:

$$T \cdot a - t \cdot b \approx 0$$

where T equals the tension due to the lower riser portions, a equals the radial distance from the line of action of T to the line extending between the connections of said tethers to said beam assembly, t equals the tension due to the upper portions of the riser system, and b equals the radial distance from the line of action of t to the line extending between the connections of said tethers to said beam assembly.

20. An assembly as recited in claim 19, wherein the upper riser portions of the riser system are flexible.

21. An assembly as recited in claim 19, wherein the upper riser supports comprise at least one of arches, inverted U-shaped piping spools, funnels, and guide posts.

22. An assembly as recited in claim 19, wherein said tethers are located in a single plane.

23. A mid-water tethered buoyant support assembly for a riser system for use in water to bring fluids from seabed equipment to a production vessel at the surface, the tethered buoyant support assembly comprising:

at least two tethers extending from seabed anchors, said tethers being located in and defining a single plane over at least a portion of their length;

a beam assembly extending between and connected to the tops of said tethers;

buoyancy means attached to said beam assembly for buoyantly supporting said beam assembly, so as to maintain tension in said tethers; and hangers for suspending lower riser portions, said hangers being mounted at spaced positions along said beam assembly and positioned so that lines of action of tension due to the weight of the suspended lower riser portions are closely adjacent to, or on, a line formed by the intersection of said beam assembly at the level of the hangers and the plane defined by said tethers, to minimize or eliminate a turning moment imparted to the beam assembly, which tends to cause rotation of the beam assembly around its major axis, as a result of the weight of the suspended lower riser portions.

24. A mid-water tethered buoyant support assembly for a riser system for use in water to bring fluids from seabed equipment to a production vessel at the surface, the tethered buoyant support assembly comprising:

at least two tethers extending from seabed anchors, wherein said tethers are located in a single plane;

a beam assembly extending between and connected to the tops of said tethers at connections, such that the connections of said tethers to said beam assembly are disposed along said beam assembly to define a line extending between the connections;

buoyancy means attached to said beam assembly for buoyantly supporting said beam assembly, so as to maintain tension in said tethers; and hangers for suspending lower riser portions, said hangers being mounted at spaced positions along said beam assembly, said hangers being positioned closely adjacent to, or on, a line extending between the connections of said tethers to said beam assembly, to minimize or eliminate a turning moment applied to said beam assembly, which tends to cause rotation of said beam assembly around its major axis, as a result of the weight of the suspended lower riser portions.

25. A mid-water tethered buoyant support assembly for a riser system for use in water to bring fluids from seabed equipment to a production vessel at the surface, the tethered buoyant support assembly comprising:

at least two tethers extending from seabed anchors, said tethers defining a plane over at least a portion of their length;

a beam assembly extending between and connected to the tops of said tethers;

hangers attached to said beam assembly for suspending lower riser portions; and upper riser supports attached to said beam assembly for suspending upper portions of the riser system, wherein said hangers and said upper riser supports are positioned in a radial direction relative to said beam assembly such that the following condition is met:

$$T \cdot a - t \cdot b \approx 0$$

where T equals the tension due to the lower riser portions, a equals the radial distance from the line of action of T to a line formed by the intersection of said beam assembly at the level of the tethers and the plane defined by said tethers, t equals the tension due to the upper portions of the riser system, and b equals the radial distance from the line of action of t to the line extending between the connections of said tethers to said beam assembly.

26. An assembly as recited in claim 25, wherein the upper riser portions of the riser system are flexible.

27. An assembly as recited in claimed 25, wherein said tethers are located in a single plane.

* * * * *